US005647615A

United States Patent [19]

Messier

[11] Patent Number: 5,647,615

[45] Date of Patent: Jul. 15, 1997

[54] BALLOON TYING APPARATUS

[76] Inventor: William L. Messier, R.D. #1, Box 272-C, East Montpelier, Vt. 05651

[21] Appl. No.: 500,264

[22] Filed: Jul. 10, 1995

[51] Int. Cl.[6] ..... B65H 69/04

[52] U.S. Cl. ..... 289/2; 289/17

[58] Field of Search ..... 289/2, 4, 13, 15, 289/17, 18.1; 446/220, 222

[56] References Cited

U.S. PATENT DOCUMENTS

| | | | |
|---|---|---|---|
| 4,510,653 | 4/1985 | Semanko | 289/17 |
| 4,989,906 | 2/1991 | Peverley | 289/17 |
| 5,039,142 | 8/1991 | Muma | 289/17 |
| 5,104,160 | 4/1992 | Cheng | 289/17 |
| 5,314,217 | 5/1994 | Place | 289/17 |

FOREIGN PATENT DOCUMENTS

| | | | |
|---|---|---|---|
| 167753 | 4/1922 | United Kingdom | 289/17 |
| 853226 | 11/1960 | United Kingdom | 289/17 |

*Primary Examiner*—Michael A. Neas

*Attorney, Agent, or Firm*—Thomas N. Neiman

[57] ABSTRACT

The balloon tying apparatus is designed to provide a stable platform for individuals engaged in tying balloons. The apparatus is comprised of a main support platform that is in the form of a flat surface. A plurality of upper support members extends from the main support platform. A extension unit is positioned below the upper support members. The extension unit can be U shaped or in the form of parallel walls. The inflated balloon is positioned between the upper support members and the stem of the balloon is stretched below the extension unit. The stem of the balloon is wrapped around the outside of the U shaped extension unit or around the parallel wall and then passes through the center of the extension unit. As the stem is then pulled away from the main support platform a knot is formed in the stem. Variations in the basic structure include the attachment of handle for the portable unit and the addition of a stem stopping addition on the extension unit and a string integration unit to assist the user in the tying of string to the balloon. The apparatus is also designed to be fastened to a permanent location.

3 Claims, 3 Drawing Sheets

BALLOON TYING APPARATUS

BACKGROUND OF THE INVENTION

This invention pertains to children's balloons, and in particular, to a balloon tying apparatus that is designed to allow an individual to more easily tie blown up balloons without the use of accessory pieces.

This application relates to inventions disclosed in the United States Patent Office Disclosure Document program on 27 Dec. 1994, number 367,592; also filed on 27 Feb. 1995, number 371,016; and filed on 6 Mar. 1995, number 371,501.

It is very common for individuals who sell balloons at fairs, parades, festivals and parties and the like to use a plastic clip of some type to pinch off the stem and keep the balloon expanded. This practice is not only expensive, but also is environmentally unsound, as after the child finishes playing with the balloon or it is destroyed the plastic clip is then disposed in the trash. This adds to the volume of trash that has to be dealt with.

It is the object of this invention to teach a balloon tying apparatus that is easy to manufacture and easy to use. Another object of this invention is to teach an apparatus that is lightweight and very effective to operate. Also, it is the object of this invention to teach a balloon tying apparatus which avoids the disadvantages and limitations, recited above of previous balloon tying systems.

SUMMARY OF THE INVENTION

Particularly, it is the object of this invention to teach a balloon tying apparatus, for use by individuals when handling a volume of balloons without the need to use accessory equipment, comprising a main support platform; said main support platform having a plurality of upper support members for allowing the user to position a blown up thereon: and said main support platform further having a stem extension unit for permitting the user to stretch the stem of said balloon around. It is another object of this invention to teach a method of tying a balloon, for use by individuals when handling a volume of balloons without the need to use accessory equipment, comprising the steps of providing a balloon tying apparatus for allowing an individual to tie the stem of a balloon quickly and effectively; blowing up a balloon; positioning the blown up balloon on the balloon tying apparatus; stretching the stem of the balloon around the stem extension unit of the balloon tying apparatus; pulling the stem through the center of the stem extension unit of the balloon tying apparatus; and withdrawing the blown up balloon from the balloon tying apparatus which forms a knot in the balloon's stem.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 2:
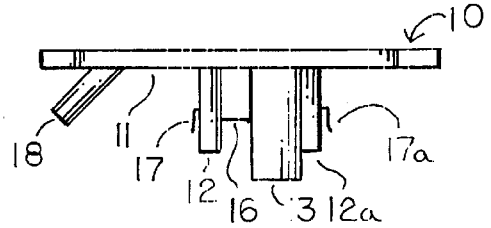
FIG. 2 is top plan view thereof.
Figure 4:
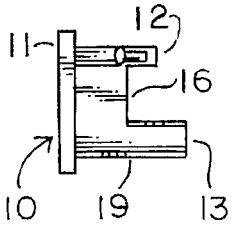
FIG. 4 is a right side elevational view thereof.
Figure 1:
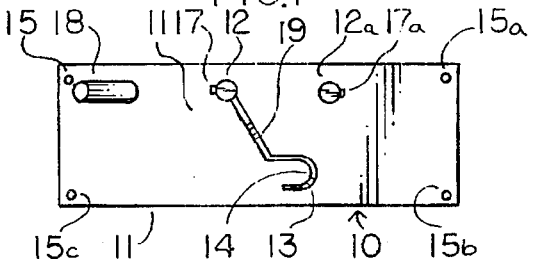
FIG. 1 is a front elevational view of the novel balloon tying apparatus.
Figure 5:
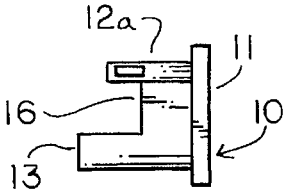
FIG. 5 is a left side elevational view thereof.
Figure 3:
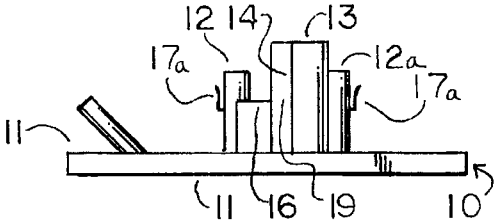
FIG. 3 is a bottom plan view thereof.
Figure 6:
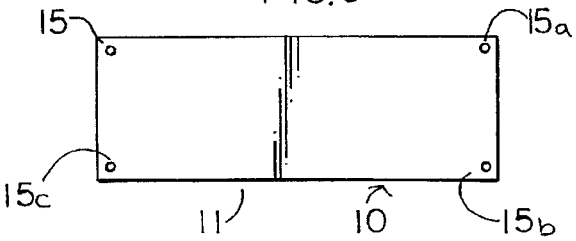
FIG. 6 is a rear elevational view thereof.

As shown in the figures, the novel apparatus 10 comprises a main support platform 11 that is designed as a flat surface, although the apparatus 10 can be designed to fit the arcuate surface of a helium or compressed gas tank. From the surface are a plurality of upper support members 12 and 12*a* that are dowel like members that are designed to be attached to the main support platform 11 and provide a location that a blown up balloon can be rested upon. Positioned below the upper support members 12 and 12*a* is an arcuate U shaped stem extension unit 13, which is referred to as a finger tube that has a flared extension piece 19. The user of the apparatus 10 would position the blown up balloon on the upper support members 12 and 12*a* and then stretch the balloon stem around the outside of the arcuate U shaped stem extension unit 13. The stem is then pulled through the inner channel 14 of the arcuate U shaped stem extension unit 13 which will form a knot in the stem as it is pulled away from the balloon tying apparatus 10. The apparatus 10 has apertures 15, 15*a*, 15*b* and 15*c* located in the corners of the main support platform 11 in order to allow the apparatus to be secured on a permanent position by using screws or the like through those apertures. Optional features shown in FIGS. 1 through 6 include the stem stop plate 16 that restricts the balloon stem movement during the tying process so as not to block the U shaped extension unit from receiving the balloon stem while forming the knot; the string clips 17 and 17*a* attached to the upper support members 12 and 12*a* that are used to integrate the string into the knot if desired by the user; and the stay 18 positioned in the upper corner of the main support platform 11 is designed to hold the string on blown up balloons as other are being tied. The aperture 19 allows the string to proceed from the roll of string through the aperture 19 to the support member 12 that has the string clip 17 attached for receiving the string. The string is integrated into the balloon knot during the tying process and then is draped on the stay 18. This allows the user to form a continuous line of balloons if he or she desires. The string can be cut if individual separate balloons are sought.

Figure 9:
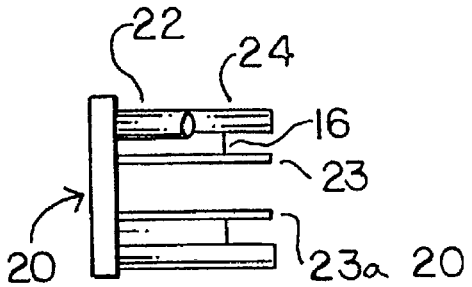
FIG. 9 is a side elevational view thereof.
Figure 7:
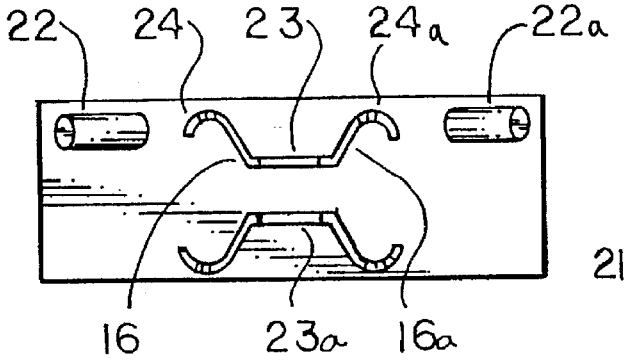
FIG. 7 is a front elevational view of an alternate embodiment of the novel balloon tying apparatus.
Figure 8:
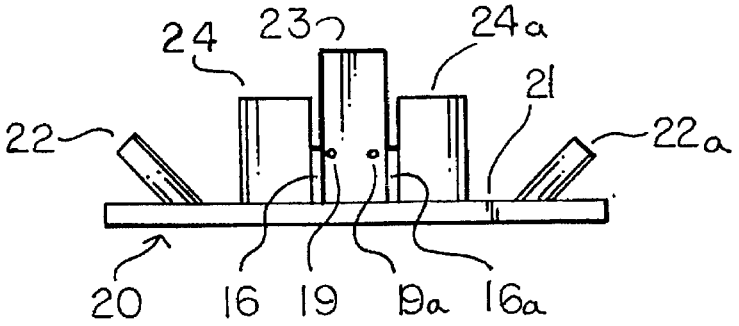
FIG. 8 is a top plan view thereof.
Figure 10:
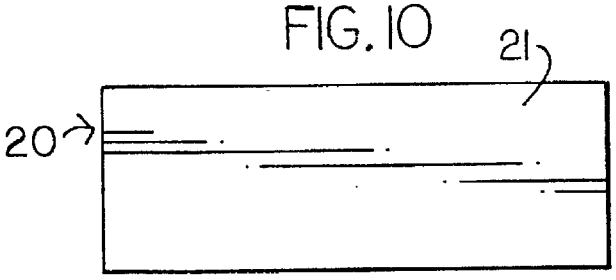
FIG. 10 is a rear elevational view thereof.
Figure 11:
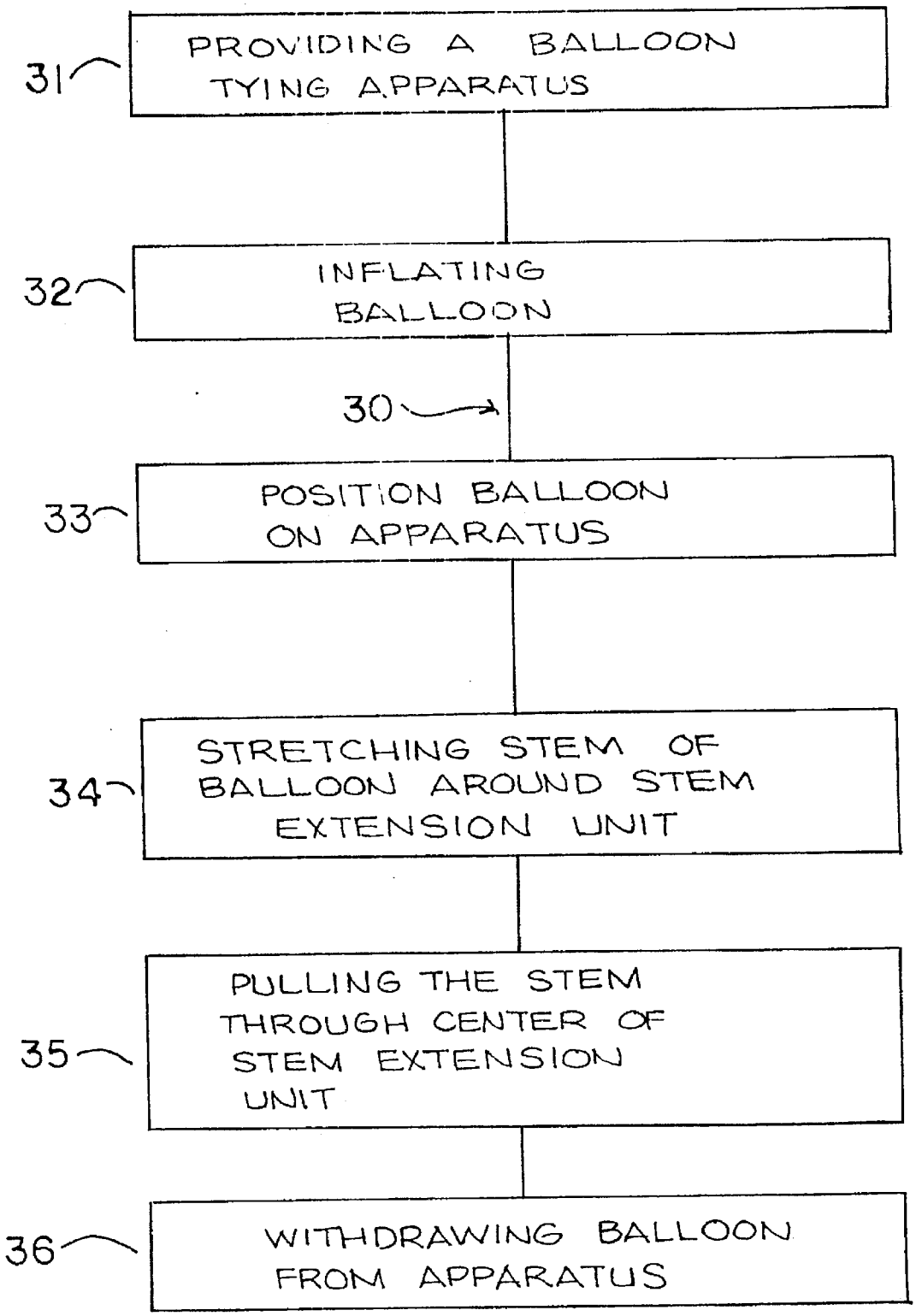
FIG. 11 is a block diagram of the novel method.

The embodiment shown in FIGS. 7 through 10 of the apparatus 20 is designed to accommodate right or left handed individuals and shows the main support platform 21 with two angled stays 22 and 22*a*. The stem extension unit 23 and 23*a* is in the form of a pair of parallel extensions with arcuate (rather than flared) stem support plates 24 and 24*a* along with stem stop plates 16 and 16*a* so that individuals can use the unit right or left handed. The process for operating the apparatus is just the same. The user rests the blown up balloon on the angled upper support members, stretches the stem around the side of the upper stem extension unit and below the lower stem extension unit and then pulls the stem through the center of the two extension units. A knot is formed and tightened as the balloon is removed from the apparatus.

A number of alternate embodiments can be used. The apparatus can be designed having clamps with apertures to receive a strap which would be wrapped around the helium or compressed gas cylinder to hold the apparatus. The same could be accomplished by means of hook and loop fabric material. A handle can be fastened to the back of the main support platform that would allow the user to hold the apparatus in one hand and operate the apparatus.

The novel method 30 comprises the steps of providing a balloon tying apparatus for allowing an individual to tie the stem of a balloon quickly and effectively 31; blowing the balloon up 32; positioning the expanded balloon on the balloon tying apparatus 33; stretching the stem of the balloon around the stem extension unit of the balloon tying apparatus 34; pulling the stem through the center of the stem extension unit of the balloon tying apparatus 35; and withdrawing the blown up balloon from the balloon tying apparatus which forms a knot in the balloon's stem 36.

While I have described my invention in connection with specific embodiments thereof, it is clearly to be understood that this is done only by way of example and not as a limitation to the scope of my invention as set forth in the objects thereof and in the appended claims.

I claim:

1. A balloon tying apparatus, for use by individuals when handling a volume of balloons without the need to use accessory equipment, comprising:

a main support platform;

said main support platform having a base section;

said main support platform having a plurality of upper support members for allowing the user to position a blown up balloon thereon;

said upper support members comprising dowels extending upward away from said main support platform;

said upper support members having string clips connected thereto for permitting the user to integrate string in the knot as it is being formed;

said main support platform further having a stem extension unit for permitting the user to stretch the stem of said balloon around;

said stem extension unit comprising an arcuate housing of U shaped design positioned below said upper support members for allowing said user to stretch said stem of said blown up balloon around the exterior of said arcuate housing and then the stem is passed through the interior of said arcuate housing forming a knot in said stem when said balloon is pulled away from said balloon tying apparatus; and said arcuate housing having flaring means extending from one end of said U shaped design for restricting the movement of said stretched stem.

2. A balloon tying apparatus, according to claim 1, wherein:

said stem extension unit further having at least one aperture located therein for permitting the passage of string through said stem extension unit.

3. A balloon tying apparatus, for use by individuals when handling a volume of balloons without the need to use accessory equipment, comprising:

a main support platform;

said main support platform having a base section;

said main support platform having a plurality of upper support members for allowing the user to position a blown up balloon thereon;

said upper support members comprising dowels extending upward away from said main support platform.;

said upper support members having string clips connected thereto for permitting the user to integrate string in the knot as it is being formed;

said main support platform further having a stem extension unit for permitting the user to stretch the stem of said balloon around;

said stem extension unit comprising two parallel members positioned below said upper support members for allowing said user to stretch said stem of said balloon around said parallel members and then said stem is passed between said parallel members forming a knot in said balloon when said balloon is pulled away from said balloon tying apparatus; and one of said parallel members having flaring means attached thereto for restricting the movement of said stretched stem.

* * * * *